US006666204B1

(12) United States Patent
Hedrick

(10) Patent No.: US 6,666,204 B1
(45) Date of Patent: Dec. 23, 2003

(54) ROTATING ARROW DISPENSER

(76) Inventor: James Kenneth Hedrick, 4925 Callison Rd., Bradley, SC (US) 29819

( * ) Notice: Subject to any disclaimer, the term of this patent is extended or adjusted under 35 U.S.C. 154(b) by 0 days.

(21) Appl. No.: 10/229,472

(22) Filed: Aug. 28, 2002

Related U.S. Application Data

(60) Provisional application No. 60/315,643, filed on Aug. 30, 2001.

(51) Int. Cl.[7] ..... F41B 5/06

(52) U.S. Cl. ..... 124/86; 124/25.5; 224/916

(58) Field of Search ..... 124/25.5, 25.7, 124/86, 88; 224/916

(56) References Cited

U.S. PATENT DOCUMENTS

| | | | | |
|---|---|---|---|---|
| 2,984,277 A | | 5/1961 | Neff | |
| 3,116,730 A | | 1/1964 | Tingley | |
| 3,337,099 A | | 8/1967 | Rose | |
| 3,777,734 A | | 12/1973 | Rose | |
| 4,541,403 A | | 9/1985 | DeBlois | |
| 4,869,226 A | * | 9/1989 | Wu | |
| 5,690,088 A | | 11/1997 | Ruble | |
| 5,775,314 A | * | 7/1998 | Michael et al. | 124/86 |
| 5,934,531 A | * | 8/1999 | Jablonic et al. | |
| 6,305,534 B1 | | 10/2001 | Neal | |
| 6,330,881 B1 | | 12/2001 | Pippard | |

* cited by examiner

*Primary Examiner*—John A. Ricci
(74) *Attorney, Agent, or Firm*—Robert W. Pitts

(57) ABSTRACT

A relatively simple and lightweight rotatable quiver can be mounted on a bow. The quiver includes a rotatable subassembly including slotted discs mounted on a central rod. The rotatable subassembly is mounted within a stationary subassembly including two spaced apart split rings mounted on a quiver bracket. When slots in the disc are aligned with an opening formed by the distal ends of the split ring, an arrow can be inserted or removed. An O-ring mounted on the disc intersects the slots and urges the arrows radially outward into engagement with the inside surface of the split rings so that the arrows are held tightly in the quiver regardless of the size of the arrow. A lock mechanism and device mounting components can also be mounted on the quiver bracket.

20 Claims, 8 Drawing Sheets

ROTATING ARROW DISPENSER

CROSS REFERENCE TO CO-PENDING PROVISIONAL PATENT APPLICATION

This application claims benefit of the filing date of US Provisional Patent Application Ser. No. 60/315,643 filed Aug. 30, 2001.

BACKGROUND OF THE INVENTION

1. Field of the Invention

This invention is related to archery quivers or arrow dispensing devices and more particularly to rotatable quivers that can be mounted on a bow or other device.

2. Description of the Prior Art

Different Prior Art quivers have been used to store arrows for use by an archer. The most common type of quiver is one in which multiple arrows are stored in a side by side configuration with the individual arrows held in slots or clips of common configuration. An example of this type of prior art quiver is shown in FIG. 18, which shows a bow 100 with a prior art quiver 110 mounted on the bow. This prior art quiver is shown in more detail in U.S. Pat. No. 6,330,881. Some attempts have been made to provide a configuration in which the arrows can be rotated into a position in which the arrows can be released one at a time. Addition of a rotating capability has historically added cost, complexity and weight to the quiver, making rotatable quivers less desirable, especially when mounted directly to the bow. Insertion and removal of arrows from prior art rotatable quivers can also involve relatively complicated maneuvers accounting for the lack of acceptance of some of these prior art devices.

U.S. Pat. No. 3,116,730 discloses a rotating quiver having a pair of spider discs made of flexible rubber with evenly spaced openings for retaining the shaft of an arrow at spaced locations. The discs are mounted on a spindle, and the spindle is mounted on upper and lower brackets that can be used to mount the quiver on a bow. The brackets extend between two adjacent arrows, so the quiver cannot be freely rotated to any position.

U.S. Pat. No. 3,337,099 and U.S. Pat. No. 3,777,734 disclose a quiver in which a hunter may insert the head of an arrow into one of several slotted openings in a holder so that the arrowheads are wedged therein. The shafts of the arrows can be wedged into cutouts in a shaft supporting member that is formed by sandwiching a pliable member with cutouts between two more rigid plastic members. Although the arrows can be rotated, a compound movement appears necessary in order to insert or remove the arrows from the quiver, because the hunter must thread the arrowhead into one of the slotted openings designed to receive arrowheads of different shapes. Furthermore the two arrowhead and shaft retaining units have different shapes which would appear to increase the expense of this device.

U.S. Pat. No. 5,690,088 discloses a quiver having a cylindrical housing with a lid having a closed-cell foam filler for receiving the point of an arrowhead. The lid is attached to an arrow retaining ring and this subassembly can be rotated within an outer shell which includes a slot. A door on the arrow retaining ring can be positioned to close this slot and the arrows can be rotated into alignment with the slot. However, the intent of this device appears to be to completely close the arrows, unless the subassembly is rotated to align a single arrow for removal from the quiver. Although such a device may protect the arrows, it would appear that this device is relatively bulky and that it would be difficult to insert or remove arrows from the quiver.

SUMMARY OF THE INVENTION

The instant invention provides a simple, compact, light weight, rotatable quiver with a minimum number of parts. At the same time the arrows are held securely in the quiver and, but can be released by simply rotating the arrows. The arrows are inserted or removed by lateral motion without the need for complicated compound movement. The arrows can also be fully enclosed by a removable cover.

According to this invention, a quiver for holding a plurality of arrows, the quiver includes a stationary subassembly and a rotatable subassembly. The stationary subassembly includes two spaced apart split rings joined by a bracket affixed to each split ring. Each split ring includes an opening between distal ends. The openings in the split rings are aligned so that an arrow can be simultaneously laterally inserted or removed through the aligned openings. Each slit ring is affixed to the bracket at a point circumferentially spaced from the split ring opening so that the bracket does not interfere with insertion and removal of an arrow through the split ring openings. The rotatable subassembly includes first and second discs each including a plurality of radially extending slots. Each slot has a width sufficient to receive an arrow inserted laterally therein. Each disc is positioned within an associated split ring so that the disc is free to rotate relative to the associated split ring. A central rod extends between the two discs. Each disc is attached to the central rod so that the rotatable subassembly is rotatable relative to the stationary subassembly. Each arrow is held in associated slots in the two spaced apart discs by the split rings, until the rotatable subassembly is rotated to a position in which a slot holding an arrow is aligned with openings in the split rings so that an arrow can be removed.

According to the preferred embodiment, the quiver can store arrows within a rotating magazine located within an outer member, such as a pair of split rings. This magazine includes at least one disc having a plurality of radially oriented slots. Each slot is open to a peripheral surface on the disc and has a width sufficient for receipt of an arrow shaft. The disc includes a segmented circumferential groove extending between the slots and intersecting the slots. The groove is radially spaced from a root of at least one slot. A resilient ring is located in the circumferential groove. This resilient ring is deflectable inwardly toward the root of a slot in which an arrow is positioned. The outer member has an inwardly facing circumferential surface in which the disc is located. The resilient ring urges an arrow located in a slot outwardly into engagement with the circumferential surface to grip an arrow in a slot. The disc is rotatable relative to the outer member. The outer member includes at least one opening though which an arrow can be inserted or removed when one slot on the disc is aligned with the opening.

This quiver can be part of a quiver assembly kit including a quiver attachable to and detachable from other archery components, such as a bow and a hip quiver bracket. The quiver in the quiver assembly kit includes a quiver bracket in the form of a bar having a plurality of threaded and smooth holes spaced apart between opposite ends of the quiver bracket. The quiver also includes an arrow magazine means mounted on one side of the quiver bracket. A bow bracket mountable on a bow is attachable to the quiver bracket on a second side of the quiver bracket. The bow bracket includes a pair of dog-leg slots for receiving a pair of screws extending from the quiver bracket bow so that the quiver can be mounted on a bow. The kit also includes a hip bracket also attachable to the second side of the quiver bracket. A tubular cover is removably mountable on the quiver to enclose the arrow magazine means. The tubular cover includes a cover slot for receiving the quiver bracket when the tubular cover is mounted on the quiver with the second side of the bow bracket being exposed so that the bow bracket or hip bracket are exposed when the tubular cover encloses the arrow magazine means.

DETAILED DESCRIPTION OF THE PREFERRED EMBODIMENT

Figure 17A:
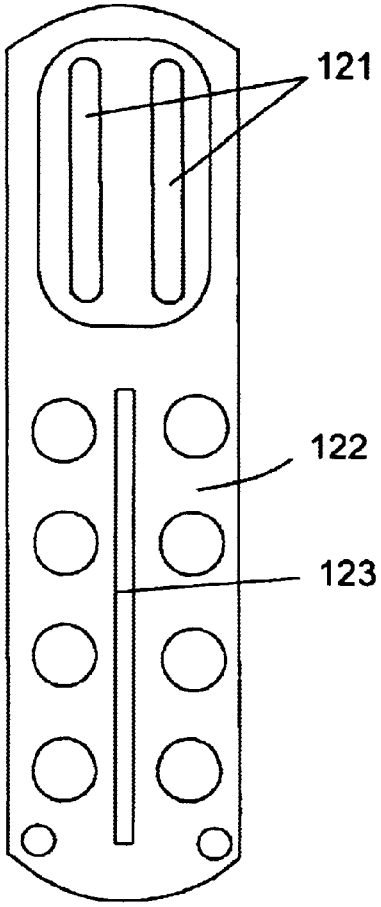
FIG. 17A is a view of a plate forming part of a hip bracket, shown in FIG. 17B, that can be attached to the rotating quiver.
Figure 17B:
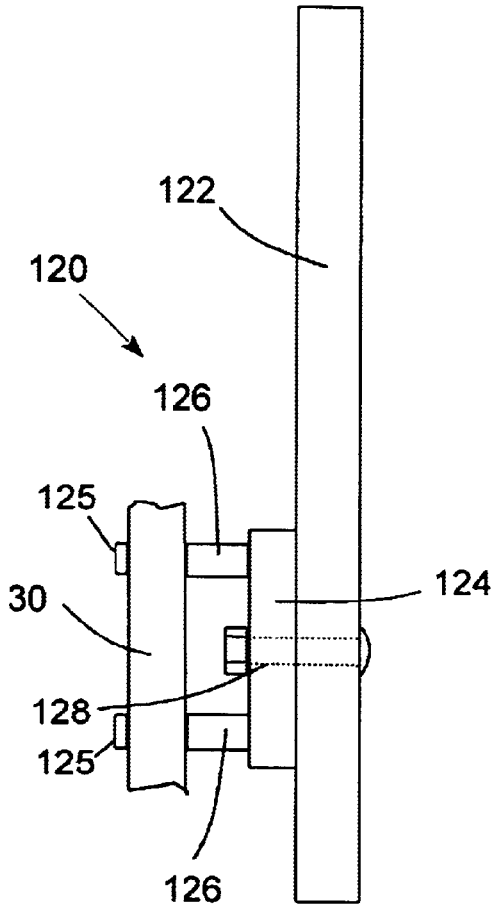
Figure 18:
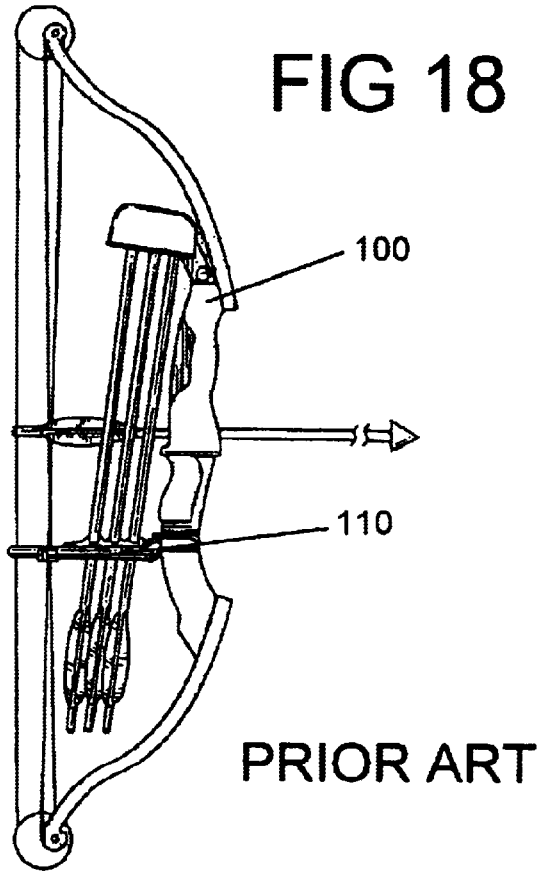
FIG. 18 is a view of a prior art quiver mounted on a bow.
Figure 16:
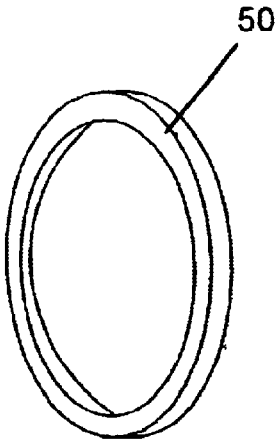
FIG. 16 shows a view of a resilient O-ring that is used hold an arrow within an arrow holding disc.

The quiver or arrow dispenser 10 according to the preferred embodiment of this invention can be used to store and dispense a plurality of arrows 2. The quiver 10 can be mounted on a conventional bow 100, of the type shown in FIG. 18 or on a hip bracket 120, as shown in FIGS. 17A and 17B, or it can be mounted on a tree stand or on some other device or component. The quiver 10 includes a stationary subassembly 12 and a rotatable subassembly or rotating magazine 14. Rotation of the magazine 14 presents the arrows 2 for removal by the archer and orients the magazine 14 so that the arrows can be inserted into the quiver. Arrows 2 can be inserted or removed simply by moving the arrow substantially laterally of its axis relative to the quiver. Little compound movement is required because the arrowhead hood 54 protecting arrowheads 4 is relatively open.

Figure 1:
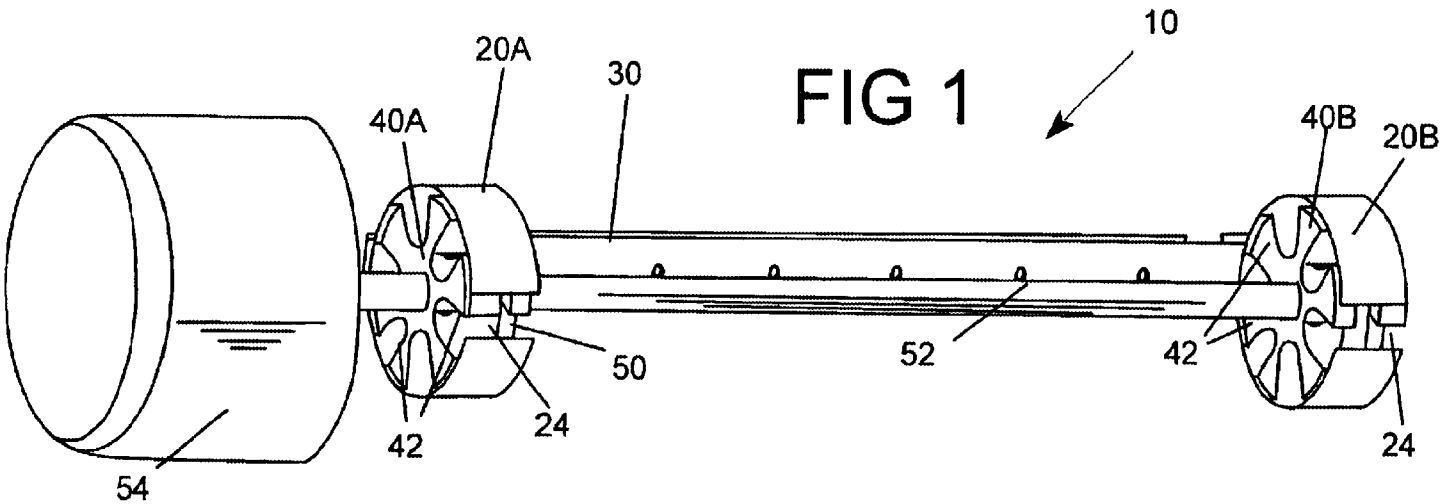
FIG. 1 is a three dimensional view of a quiver or arrow dispenser in accordance with this invention.
Figure 2:
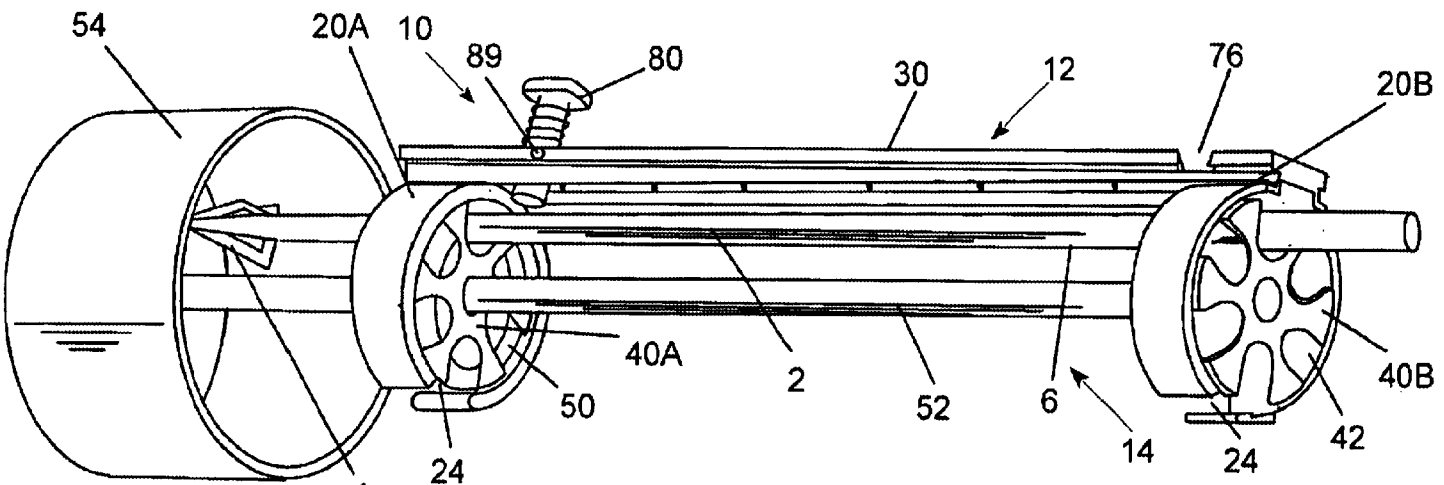
FIG. 2 is a three dimensional view from a different orientation showing a representative arrow positioned within the quiver.

The stationary subassembly 12 includes a quiver bracket 30 to which two spaced-apart split rings 20A and 20B are mounted as shown in FIGS. 1 and 2. The rotatable subassembly 14 includes a pair of rotating discs 40A and 40B positioned on the interior of the two split rings 20A and 20B. These rotating discs 40A and 40B are mounted on a split rod 52 and an arrowhead hood 54 is also attached to the central rod at one end of a quiver.

As shown in FIG. 2, an arrow 2 is mounted in one of the radially extending or oriented slots 42 in the two spaced-apart discs 40A and 40B. The arrow shaft 6 extends through aligned slots 42 and the arrowhead or broadhead extends in to the interior of the hood 54. In the representative embodiment of depicted herein, up to six arrows 2 can be positioned in the six slots 42 diverging from the center of each disc 40A or 40B. As seen in FIG. 2, the arrow 2 is trapped in its slot 42 by the split rings 20A and 20B when the arrow 2 is in the angular position shown there. The discs 20A and 20B, along with the central rod 52 and the hood 52, can be rotated relative to the split rings 20A and 20B and to the quiver bracket 30 on which they are mounted. Since the split rings 20A and 20B having aligned openings 24 circumferentially spaced from the point on the opposite side where the split rings 20A and 20B are mounted on the quiver bracket 30, arrows 2 can be inserted or removed from the quiver 10 when the slots 42, in which they are held, are rotated into alignment with the two openings 24. The rotatable subassembly 14 can be rotated relative to the stationary subassembly 12 by grasping arrows 2 between the two split rings 20A and 20B and turning the rotatable subassembly 14.

Figure 3:
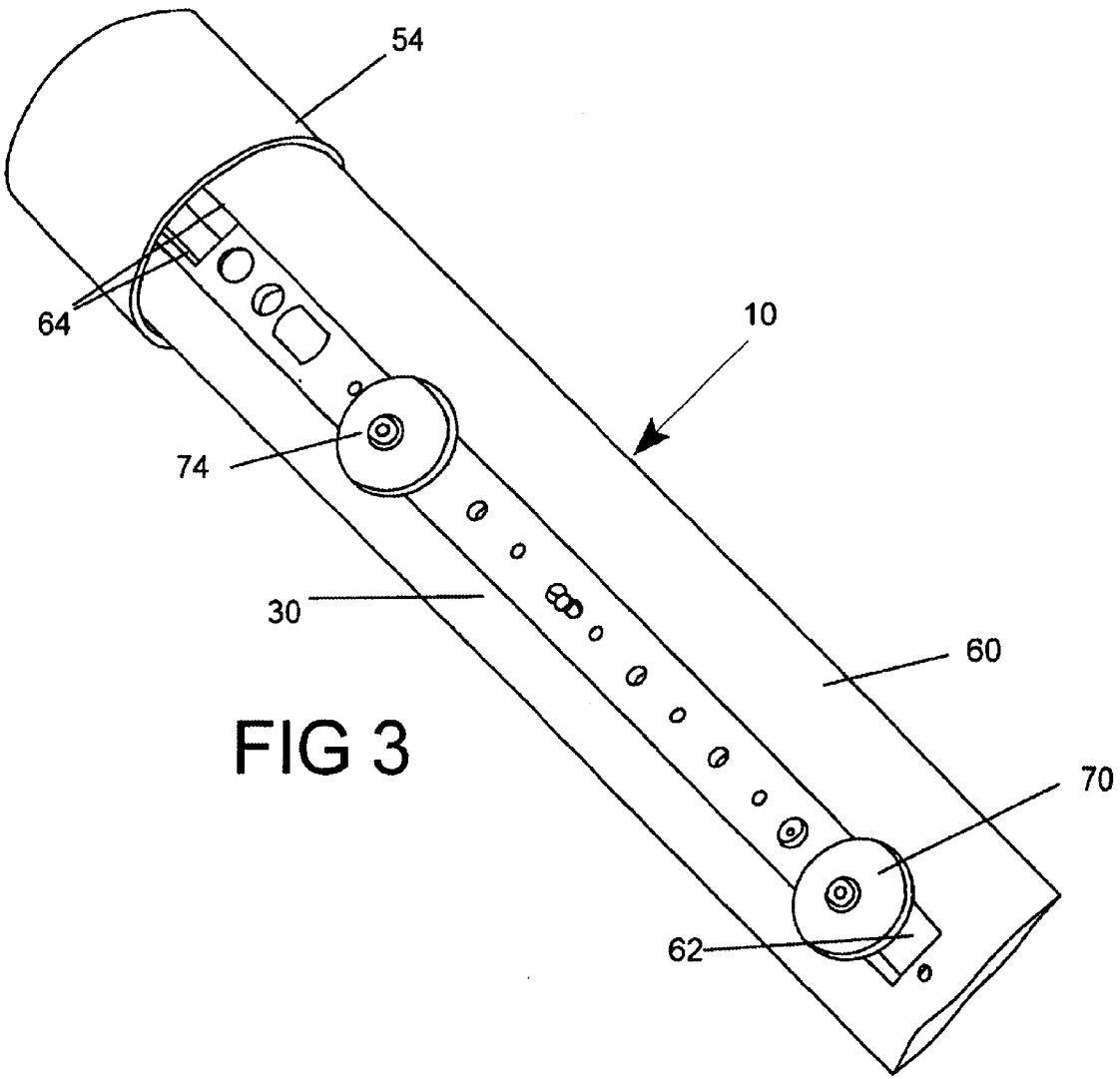
FIG. 3 is a partial three dimensional view of the of FIGS. 1 and 2 with an outer cover mounted on the quiver.

FIG. 3 shows a tubular cover 60 mounted on the quiver 10. This cover 60 can be fabricated from a tubular plastic extrusion, and it must be removed to allow access to arrows 2 held in the quiver 10. The tubular cover 60 encloses all of the quiver 10 with the exception of the quiver bracket 30, which fits within a cover slot 62 extending from the open end 66 of the cover 60. Mounting means located on the exterior face 32 of the bracket 30 also remain exposed so the cover 60 can be placed on the quiver 10 when the quiver is mounted on a bow, on a hip bracket or on another device, such as a tree stand. The tubular cover 60 is inserted over the quiver 10 by inserting the lower end of the quiver 10 into the open cover end 66 with the cover slot 62 aligned with the quiver bracket 30. The cover slot edges 64 fit within longitudinally extending channels 38 extending along opposite edges of the quiver bracket 30 extending between the bracket outer face 32 and the bracket inner face 34. A thumbnut 70 mounted on the quiver bracket 30 can be rotated to secure the tubular cover 60 to the quiver bracket 30.

Figure 4:
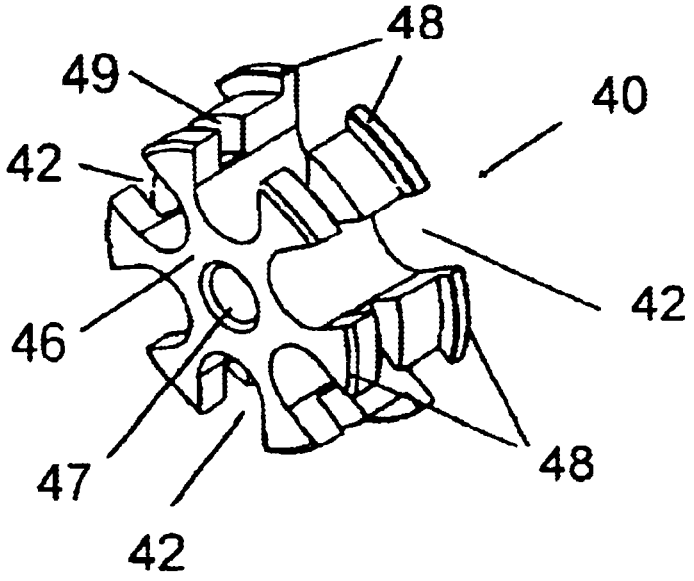
FIG. 4 is a three dimensional view of one of the arrow holding discs in which arrows can be mounted and rotated into a position in which a selected arrow can be removed from the quiver.
Figure 5:
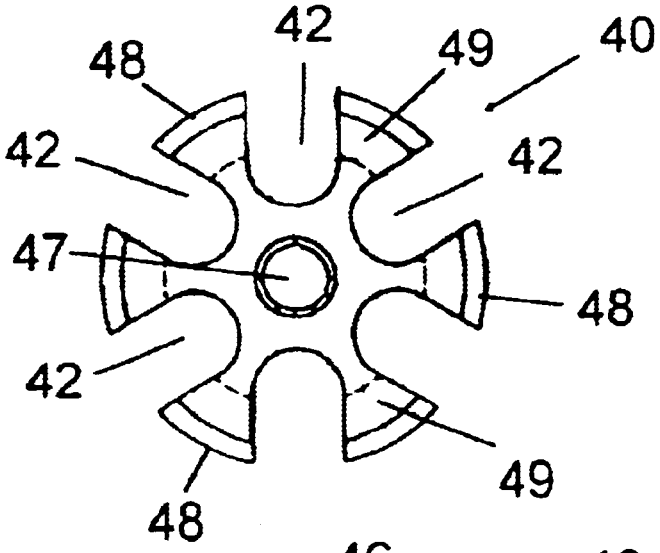
FIG. 5 is a top view of the disc shown in FIG. 4.
Figure 6:
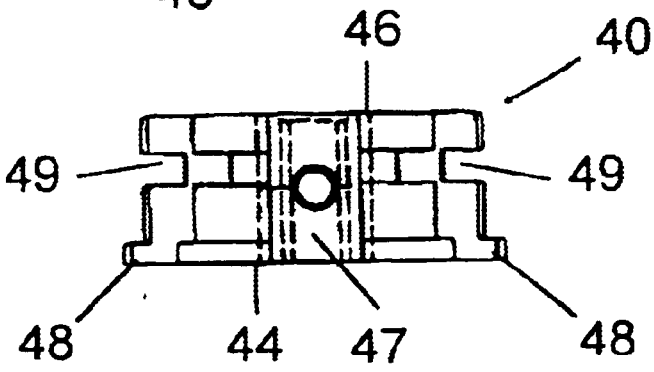
FIG. 6 is a side view of the disc shown in FIGS. 4 and 5.

The individual components that are used to fabricate the rotating quiver 10 are shown in FIGS. 4–16. FIGS. 4–5 show rotating discs or arrow holders 40. Two identical discs are shown in FIGS. 1 and 2 as upper disc arrow holder 40A and lower disc arrow holder 40B In the preferred embodiment, these discs 40 are molded from a thermoplastic. It should be understood, however that these discs could be machined from metal stock or each disc could be fabricated as separate components. The disc is basically cylindrical with radially extending slots 42 extending inwardly from the outer periphery of the disc 40. The preferred embodiment has six slots 42, although different numbers of slots 42 can be included in other embodiments. Each slot 42 extends between an upper disc face or edge 44 and a lower face or edge 46. The root of each slot is spaced from a central hole 47 that also extends between the opposite faces 44 and 46. A radially extending segmented lip 48, having a diameter greater than the remainder of the disc 40 extends from one face or edge 44. This lip 40 will overlap one edge of an associated split ring 20, to hold the disc 40 in position relative to the adjacent split ring 20. The disc 40 also includes a segment circumferential groove 49 extending around each disc 40 and intersecting each slot 42 between the slot root and the cylindrical periphery of the disc 40. This groove 49 provides space for a resilient O-ring 50. The width of each slot 42 is wide enough to receive the shafts of arrows other than arrows having more than a minimum diameter. When an arrow shaft 6 is inserted into a corresponding slot 42, the resilient O-ring 50 will be inwardly deformed. The restoring force will urge that arrow shaft 6 outward where it will be pressed against an opposed inner surface 28 on the split ring 20. The resilient O-ring 50 thus comprises means for holding arrows 2 with different diameter shafts securely within a slot 42 even if the width of the slot 42 is larger than the outer diameter of the arrow shaft 6. As seen in FIGS. 1 and 2 two discs 40A and 40B can be mounted at spaced locations on a central rod 52. FIG. 6 shows a threaded hole in which a set screw can be inserted to secure the disc 40 to the central rod 52.

Figure 8:
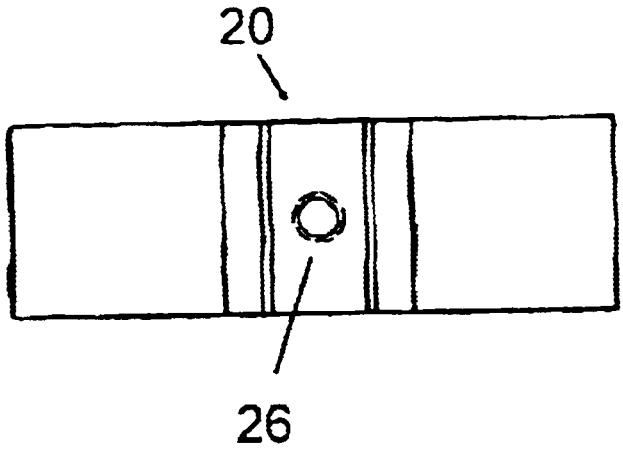
FIG. 8 is a side view showing the exterior or mounting surface of the split ring of FIG. 7.
Figure 7:
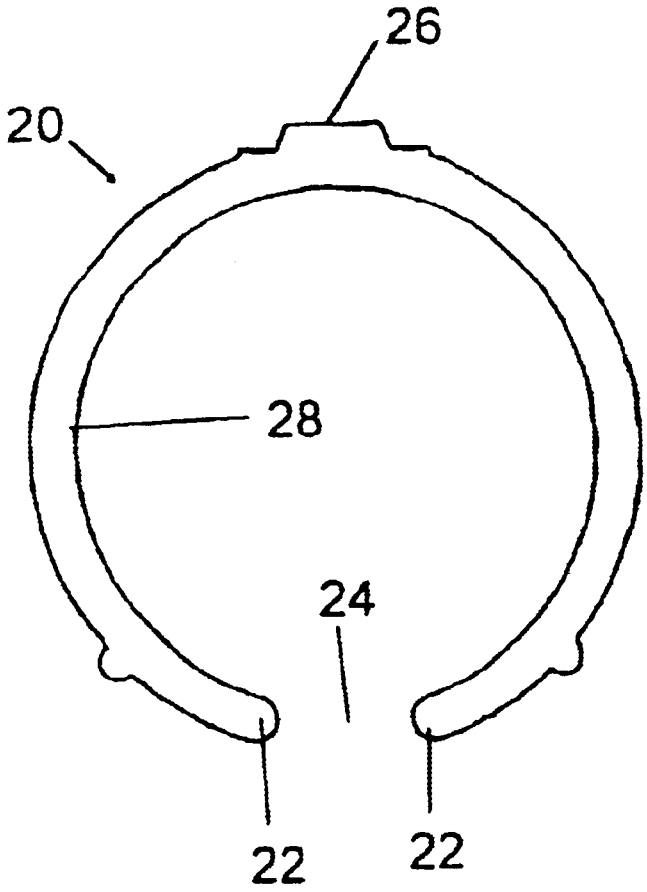
FIG. 7 is a view of one of the split rings in which the discs are mounted.

The discs 40 are positioned within the split rings 20 that are shown in more detail in FIGS. 7 and 8. In the preferred embodiment, the split rings 20 are machined from aluminum. The two split rings 20A and 20B shown in FIGS. 1 and 2 are identical. Each split ring 20 has an opening 24 between two opposed distal ends 22. The width of each opening 24 is sufficient to permit insertion and extraction of the largest diameter arrow shaft 6 with which the quiver 10 is to be used. The width of this opening 24 is greater than the width of the arrow holding slot 42 on the rotating disc 40 that is positioned within the split ring 20. The split ring 20 also includes a mounting rib 26 located on the outwardly facing surface of the split ring 20. This mounting rib is circumferentially spaced from the opening 24, and in the preferred embodiment the mounting rib 28 is approximately 180 degrees from the opening 24. A tapped hole for receiving a set screw extends through this mounting rib 28. The mounting rib 28 orients the split ring 20 relative to the quiver bracket 30, and the set screw anchors the two components together.

Figure 11:
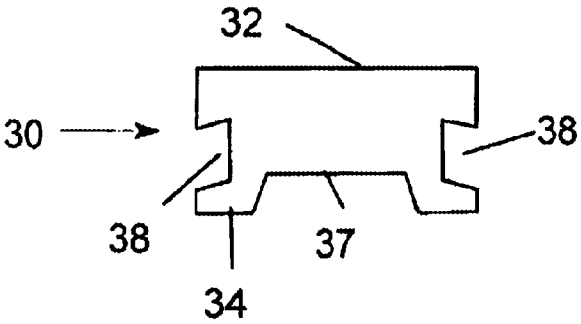
FIG. 11 is an end view of the quiver bracket of FIGS. 9 and 10.
Figure 9:
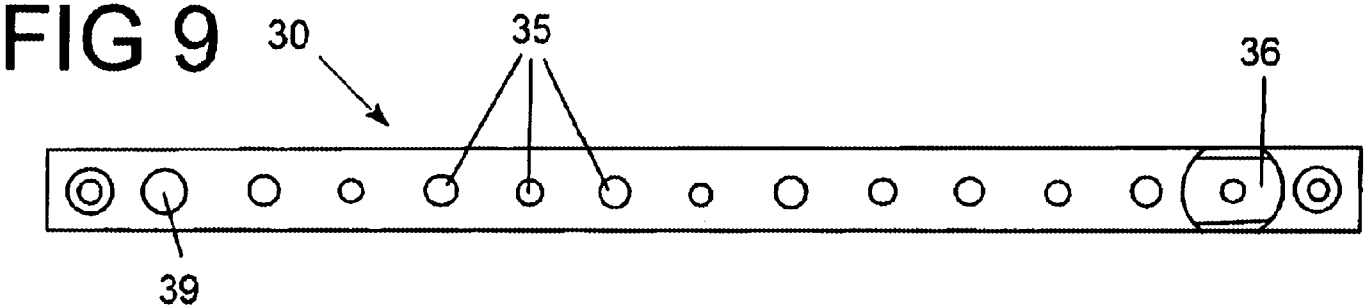
FIG. 9 is a view of the exterior face of the quiver bracket on which the split rings of FIGS. 7 and 8 are mounted.
Figure 10:
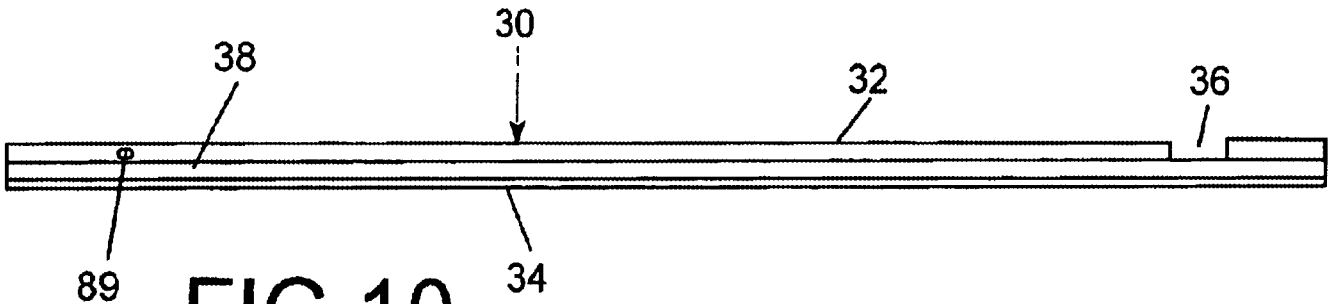
FIG. 10 is a side view of the quiver bracket of FIG. 9.
Figure 12:
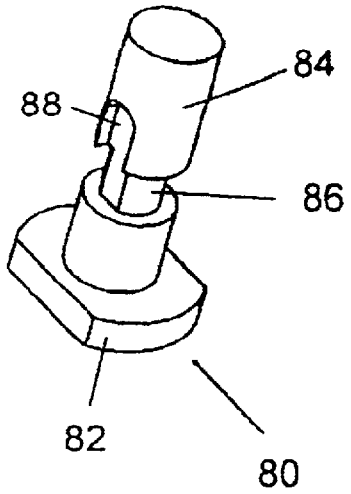
FIG. 12 is a view of a spring loaded lock that can be used to prevent rotation of the arrows positioned in the arrow holding disc.
Figure 14:
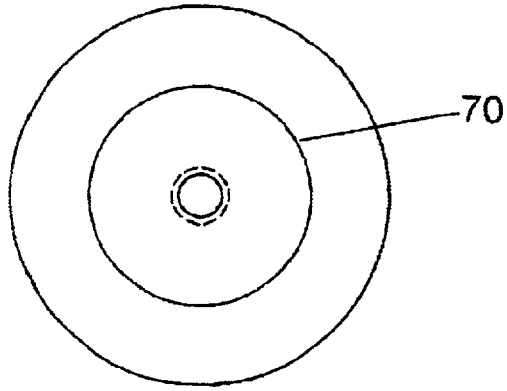
FIG. 14 is a view of a thumbnut for securing the tubular quiver to the quiver bracket.
Figure 15:
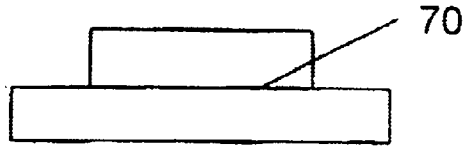
FIG. 15 is a side view of the thumbnut shown in FIG. 14.
Figure 13:
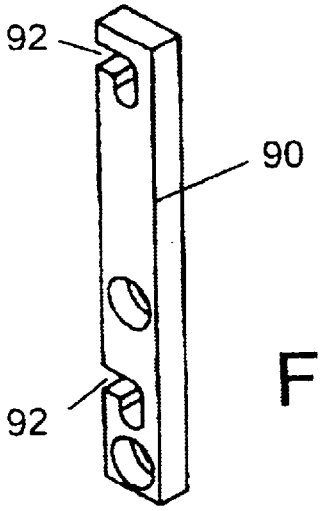
FIG. 13 is a view of an auxiliary quick mounting bracket for mounting the quiver on a bow.

The quiver bracket 30 on which the split rings 20 are mounted is shown in more detail in FIGS. 9–11. In the preferred embodiment, this bracket comprises an aluminum bar have a plurality of mounting holes 35 located between opposite ends. The mounting holes extend between the outer face 32 and the inner face 34. These mounting holes are spaced so that accessories can be mounted at suitable locations along the length of the quiver bracket. As seen in FIG. 11, a recess 37 having outwardly sloping side is located along the outer face 32. This recess 37 provides clearance so that the split ring mounting ribs 28 can be received therein and stably mounted to the quiver bracket 30 by screws or other fasteners. The bracket 30 also includes a thumbnut recess 36 adjacent its lower end. A thumbnut 70 can be mounted on a screw in this recess 36 so that rotation of the thumbnut 70 will move the thumbnut towards and away from the bracket 30 to grip or release the tubular quiver cover 60 on opposite sides of the quiver slot 62. The bracket 30 also has longitudinally extending mounting channels 38 in which the cover slot edges 64 are received when the tubular cover 60 is mounted on the quiver 10.

In addition to providing means for mounting the split rings 20, the quiver bracket 30 also comprises means for mounting a spring loaded locking member 80 adjacent the upper end of the bracket 30 in a lock hole 39, which has a diameter larger than the other holes on the quiver bracket 30. Lock member 80, which is shown in more detail in FIG. 12, has a head portion 82 that is larger than the lock hole 39. A lock shaft 84 extends from the lock head 82 and fits within the lock hole 39. A circumferential recess 86 extends around the lock shaft 84 and a longitudinally extending locking recess 88 extends from the circumferential recess 86 at one location on the lock shaft 84. A coil spring is mounted between the lock head 82 and the outer face bracket face 32 when the lock member 80 is mounted on the quiver bracket 30. A set screw threaded through the side of the quiver bracket 30 partially into the lock hole 39. This set screw or pin 89 fits within both the circumferential recess 86 and the longitudinal locking recess 88. When the lock member 80 is in an angular orientation in which the pin or set screw is aligned with the longitudinal locking recess 88, the lock member 80 can be shifted between an engaged or inner position and a disengaged or outer position. When the lock member 80 is rotated is rotated with the screw or pin aligned with the circumferential recess 86 away from the longitudinal lock recess 88, the lock 80 is held in an inner or locking position. The lock shaft 84 extends inwardly beyond the inner face 34 of the bracket 30 when the lock 80 is in the engaged or locking position. In this position the lock shaft will extend between two adjacent arrow shafts 6 so that arrows 2 in the quiver 10 cannot be rotated into alignment with the opening 24 in the split rings 20A and 20B. In other words, none the arrow holding slots 42 cannot be aligned with the split ring openings 24 and the split rings 20A and 20B capture the arrows 2 in the quiver 10 when the lock 80 is in the engaged position. To release the lock 80, the lock head 82 is rotated until the set screw is aligned with the longitudinal lock recess 88 and the will spring will force the lock 80 to its outer of disengaged position.

In addition to providing means for locking the arrows 2 located in the rotatable subassembly 14 and for mounting the cover 60, the quiver bracket also simplifies mounting of the quiver 10 to another device, such as a bow, a hip quiver or some other piece of equipment. A quick mounting bracket or auxiliary bracket 90 can be mounted on a bow, and this auxiliary bracket 90 can be quickly and easily mounted on or quickly disengaged from the quiver bracket 30 so that the quiver 10 can be easily mounted on a bow. The quick mounting bracket 90 shown in FIG. 12 includes two L-shaped or dogleg slots 92. Two pins or set screws mounted in appropriate holes on the bracket 30 can be received within the slots 92 making it easy to mount the quiver 10 on a bow. The quick mounting bracket 90 includes two mounting holes that are on standard centerlines that will match standard mounting means on most bows. The quick mounting bracket 90 is light and relatively unobtrusive, and at the same time provides for secure engagement with the bracket 30 and therefore with the quiver 10. A mounting nut 74 on a screw attached to the bracket can be rotated into position to lock the quick mounting auxiliary bracket 90 to the quiver bracket 30 and therefore to lock the quiver 10 on the bow.

The quiver 10 can also be mounted to a hip quiver 120 that an archer can attach to his belt so that the quiver can be swiveled and the arrows can be rotated in the same manner as previously described. The hip quiver 120, shown in FIGS. 17A and 17B, comprises a flat metal plate 122 having two side by side slots 121 through which a belt may be threaded. A third slot 123 longitudinally spaced from the two side by side slots provides a means for adjusting the position of the quiver relative to the bracket. The hip quiver 120 can be mounted on the quiver bracket 30 by two screws 125 extending though two of the quiver bracket holes. These screws are treaded into a swivel disc 124 at two points near the periphery of the swivel disc. Two standoff sleeves 126 surrounding the screws 125 separate the hip quiver plate 122 from the quiver bracket 30. The swivel disc 124 is bolted to the hip bracket by a bolt 128 that extends through the center of the swivel disc 124 and is positioned within the third slot 123 on the hip quiver plate 122.

The quiver 10 can be assembled by first mounting the two arrow retention discs 40A and 40B at spaced locations on the central rod 52. The segmented lips 48 are located on the outer ends with the second disc faces 46 without the lips 48 face inwardly toward each other. The hood 54 is screwed or bolted to the upper end of the central rod 52. These components, along with the resilient ring 50 form the rotatable subassembly 14. The two split rings 20A and 20B can then be slipped over the rotatable discs 40A and 40B, with the outer edges abutting the segmented disc lips 48 abutting and overlapping an adjacent edge of the associated split ring 20A or 20B. With the split rings 20A and 20B in this position, the split ring mounting ribs 26 are positioned with the longitudinally extending mounting channel 38 on the quiver bracket, and the split rings 20A and 20B are screwed to the quiver bracket 30. The lock 80 as well as accessory mounting means can be attached to the bracket 30 either before or after the split rings 20A and 20B are mounted.

Arrows 2 are inserted through the split ring openings 24 into a arrow holding slot 42 that is aligned with the split ring opening 24. The arrows 2 can be inserted substantially laterally of the axis of the arrow shaft 6 because the arrowhead 4 can be inserted into the hood 54 before inserting the shaft 6 through the opening 24. When the arrow shaft 6 enters the slot 42 the resilient ring 50 is locally depressed. The resilient ring will then urge the arrow 2 outward and it will also prevent longitudinal movement of the arrow 2. The arrow 2 can then be rotated out of alignment with the split ring opening 24 to trap the arrow shaft 6 in the corresponding slot 42 and between the deformed resilient ring 50 and the inner surfaces 28 of the split rings 20A and 20B. As long as the slot 42 is not aligned with the two aligned openings 24 in split rings 20A and 20B, the arrow will be tightly held within the quiver 10. After an entire compliment of the arrows 2 have been inserted into the circumferentially spaced arrow holder slots 24, the lock 80 can be pressed in and rotated so that the lock shaft 84 is located between two adjacent arrow shafts 6. The collective orientation of the lock 80, the slots 42 and the split ring opening 24 is such that no slot 42 can be aligned with the split ring opening 24 when the lock 80 is pushed into its locking position. None of the arrows 2 can escape so long as the lock 80 is engaged.

To remove the arrows 2, one at a time, from the quiver 10, the lock member 80 is first twisted to disengage the lock 80 from the arrow shafts 6. Once the lock member 80 is in the appropriate position, the coil spring will hold the lock member in the disengaged position. The archer can then merely twist the hood 54 until a slot 42 is aligned with the openings 24 in the two split rings 20A and 20B, at which point the selected arrow 2 will not only be released, but will be urged through the openings 24 by the deformed resilient O-ring 50. Alternatively, the archer can grasp the arrow shafts 6 to twist the rotatable subassembly. Continued rotation will allow all of the arrows 2 to be extracted from the quiver 10.

The rotatable arrow dispensing and holding quiver of the preferred embodiment is representative of other configurations that may differ but would still include the basic elements of this invention. A few of these potential modifications will be listed, even though this list is not intended to be complete. For example, the resilient O-ring member could be replaced by another resilient member that would bias the arrow in substantially the same manner. Furthermore, additional arrow holding discs could be employed. Conversely, some components, such as the hood, could be eliminated while still retaining the basic elements of this invention. Alternatively, the cover could slip over the quiver bracket without the need of the side channels in the quiver bracket. The lock means could also engage the arrow holding discs to prevent rotation instead of extending between adjacent arrows as in the preferred embodiment. Other mounting means could also be employed to attach the quiver to a bow or to attach the quiver to another structure, such as a tree stand. Therefore it should be understood that modifications apparent to one of ordinary skill in the art could be made without departing from the scope of the invention as claimed herein.

I claim:

1. A quiver for holding a plurality of arrows, the quiver comprising a stationary subassembly further comprising;

two spaced apart split rings joined by a bracket affixed to each split ring, each split ring including an opening between distal ends, openings in the split rings being aligned so that an arrow can be simultaneously laterally inserted or removed through the aligned openings, each split ring being affixed to the bracket at a point circumferentially spaced from the split ring opening so that the bracket does not interfere with insertion and removal of an arrow through the split ring openings; and a rotatable subassembly further comprising;

first and second discs each including a plurality of radially extending slots, each slot having a width sufficient to receive an arrow inserted laterally therein, each disc being positioned within an associated split ring so that the disc is free to rotate relative to the associated split ring, a central rod extending between the two discs, each disc being attached to the central rod so that the rotatable subassembly is rotatable relative to the stationary subassembly; each arrow being held in associated slots in the two spaced apart discs by the split rings, until the rotatable subassembly is rotated to a position in which a slot holding an arrow is aligned with openings in the split rings so that an arrow can be removed.

2. The quiver of claim 1 wherein the bracket is attached to a radially outward side of each split ring so as not to interfere with rotation of the rotatable subassembly relative to the split rings.

3. The quiver of claim 1 wherein each disc includes a radially extending segmented lip located along one edge of the disc, the lip being positioned to engage an associated split ring to support the rotatable subassembly in the stationary subsassembly.

4. The quiver of claim 1 wherein the central rod extends through the center of the two discs.

5. The quiver of claim 1 wherein resilient means extending into each slot comprises means for urging an arrow positioned within a slot outwardly into engagement with an associated split ring so that the slots can be wide enough to receive arrows of different diameters.

6. The quiver of claim 5 wherein the resilient means comprises an O-ring extending within a groove extending around each disc and intersecting each slot.

7. The quiver of claim 1 including an arrowhead hood spaced longitudinally from an upper split ring.

8. The quiver of claim 1 wherein the bracket comprises a longitudinally extending bar with quiver mounting means attached to the bracket so that the quiver can be mounted on another device.

9. The quiver of claim 8 wherein the bracket includes oppositely facing, aligned, longitudinally extending channels, the quiver also including a tubular cover insertable over shafts of arrows, the tubular cover including a longitudinally extending slot in which the bracket can be received with edges of the longitudinally extending slot being received in the channels on the bracket.

10. The quiver of claim 1 including a lock member mounted on the bracket, the lock, member being shiftable between an outer disengaged position and an inner locking position in which the lock member extends between two adjacent arrows to prevent rotation of the arrows when the locking member is in the inner locking position.

11. The quiver of claim 1 including quick mounting means for mounting the quiver on a bow, the quick mounting means comprising an auxiliary bracket being attachable to the bow and having L-shaped slots comprising means for receiving pins located on the bow.

12. The quiver of claim 11 including a nut threaded on a pin mounted on the bracket, the nut comprising means for gripping the auxiliary bracket to secure the quiver to the bow.

13. The quiver of claim 1 including a tubular cover having a longitudinal cover slot in which the bracket can be received, and a thumbnut attachable to the bracket and engagable with the tubular cover to secure the tubular cover to the bracket.

14. A quiver for storing arrows in a rotating magazine located within an outer member;

the magazine including;

at least one disc having a plurality of radially oriented slots, each slot being open to a peripheral surface on the disc and having a width sufficient for receipt of an arrow shaft, the disc including a segmented circumferential groove extending between the slots and intersecting the slots, the groove being radially spaced from a root of at least one slot; and a resilient ring located into the circumferential groove, the resilient ring being deflectable inwardly toward the root of a slot in which an arrow is positioned; and the outer member having an inwardly facing circumferential surface in which the disc is located, the resilient ring urging an arrow located in a slot outwardly into engagement with the circumferential surface to grip an arrow in a slot, the disc being rotatable relative to the outer member, the outer member including at least one opening though which an arrow can be inserted or removed when one slot on the disc is aligned with the opening.

15. The quiver of claim 14 wherein the disc includes an enlarged lip on one face of the disc, the lip overlapping the outer member to hold the disc in position relative to the outer member.

16. The quiver of claim 14 wherein the outer member comprises a split ring.

17. The quiver of claim 16 wherein the quiver includes a plurality of spaced apart split rings.

18. A quiver assembly kit including a quiver attachable to and detachable from other archery components, including a bow and a hip quiver bracket, the quiver assembly kit comprising:

a quiver for holding a plurality of arrows, the quiver including a quiver bracket comprising a bar having a plurality of threaded and smooth holes spaced apart between opposite ends of the quiver bracket, the quiver also including an arrow magazine means mounted on one side of the quiver bracket;

a bow bracket mountable on a bow and attachable to the quiver bracket on a second side of the quiver bracket, the bow bracket including a pair of dog-leg slots for receiving a pair of screws extending from the quiver bracket bow so that the quiver can be mounted on a bow;

a hip bracket attachable to the second side of the quiver bracket;

a tubular cover removably mountable on the quiver to enclose the arrow magazine means, the tubular cover including a cover slot for receiving the quiver bracket when the tubular cover is mounted on the quiver with the second side of the bow bracket being exposed so that the bow bracket or hip bracket are exposed when the tubular cover encloses the arrow magazine means.

19. The quiver assembly kit of claim 18 wherein arrow magazine means is rotatable relative to the quiver bracket.

20. The quiver assembly kit of claim 19 including a spring loaded lock mounted in one of the openings of the quiver bracket, the lock being shiftable between an engaged and a disengaged position, the lock extending between two arrows when in the engaged position to prevent rotation of the rotatable arrow magazine means.

* * * * *